US005280884A

United States Patent [19]

Dorri

[11] Patent Number: 5,280,884

[45] Date of Patent: Jan. 25, 1994

[54] HEAT REFLECTIVITY CONTROL FOR ATOMIZATION PROCESS

[75] Inventor: Bizhan Dorri, Clifton Park, N.Y.

[73] Assignee: General Electric Company, Schenectady, N.Y.

[21] Appl. No.: 898,609

[22] Filed: Jun. 15, 1992

[51] Int. Cl.[5] ..... C21C 1/00

[52] U.S. Cl. ..... 266/202; 266/236

[58] Field of Search ..... 266/202, 236; 222/594, 222/603; 264/12; 425/7

[56] References Cited

U.S. PATENT DOCUMENTS

| | | | |
|---|---|---|---|
| 3,592,391 | 7/1971 | Bender | 222/603 |
| 3,817,503 | 6/1974 | Lafferty et al. | 266/202 |
| 3,988,084 | 10/1976 | Esposito et al. | 222/594 |
| 4,575,325 | 3/1986 | Duerig et al. | 425/7 |
| 4,578,022 | 3/1986 | Kenney | 425/7 |
| 4,619,597 | 10/1986 | Miller | 264/12 |
| 4,619,845 | 10/1986 | Ayers et al. | 427/422 |
| 4,631,013 | 12/1986 | Miller | 425/7 |
| 4,778,516 | 10/1988 | Raman | 75/0.5 C |
| 4,801,412 | 1/1989 | Miller | 264/12 |

*Primary Examiner*—Scott Kastler

*Attorney, Agent, or Firm*—James Magee, Jr.

[57] ABSTRACT

An atomization apparatus for atomization of melts of high melting metal is taught. The apparatus includes a melt guide tube adapted to guide a molten metal from a source to an atomization zone where the molten metal is gas atomized. The melt guide tube has an inwardly tapered lower end disposed above the atomization zone. An annular gas supply means is disposed around the melt guide tube. The annular gas supply includes a gas shield for directing gas from an annular plenum of said means toward the lowermost portion of said melt guide tube. The external surface of the gas shield and the external inwardly tapered surface of the melt guide tube are spaced from each other. A highly reflective surface layer is formed on the confronting surfaces of the gas shield and melt guide tube to restrict loss of radiant heat from metal passing through said melt guide tube.

4 Claims, 3 Drawing Sheets

HEAT REFLECTIVITY CONTROL FOR ATOMIZATION PROCESS

BACKGROUND OF THE INVENTION

The present invention relates generally to closely coupled gas atomization. More particularly, it relates to methods and means by which closely coupled gas atomization processing of high melting reactive molten metal can be started and carried out with significantly reduced melt superheat.

The technology of close coupled or closely coupled atomization is a relatively new technology. Methods and apparatus for the practice of close coupled atomization are set forth in commonly owned U.S. Pat. Nos. 4,631,013; 4,801,412; and 4,619,597, the texts of which are incorporated herein by reference. As pointed out in these patents, the idea of close coupling is to create a close spatial relationship between a point at which a melt stream emerges from a melt orifice into an atomization zone and a point at which a gas stream emerges from a gas orifice to impact the melt stream as it emerges from the melt orifice into the atomization zone. Close coupled atomization is accordingly distinguished from the more familiar and conventional remotely coupled atomization by the larger spatial separation between the respective nozzles and point of impact in the remotely coupled apparatus. A number of independently owned prior art patents deal with close proximity of melt and gas streams and include U.S. Pat. Nos. 3,817,503; 4,619,845; 3,988,084; and 4,575,325.

In the more conventional remotely coupled atomization, a stream of melt may be in free fall through several inches before it is impacted by a gas stream directed at the melt from an orifice which is also spaced several inches away from the point of impact.

The remotely coupled apparatus is also characterized by a larger spatial separation of a melt orifice from a gas orifice of the atomization apparatus. Most of the prior art of the atomization technology concerns remotely coupled apparatus and practices. One reason for this is that attempts to operate closely coupled atomization apparatus resulted in many failures due to the many problems which are encountered. This is particularly true for efforts to atomize reactive metals which melt at relatively high temperatures of over 1000° C. or more. The technology disclosed by the above referenced commonly owned patents is, in fact, one of the first successful closely coupled atomization practices that has been developed.

The problem of closely coupled atomization of highly reactive high temperature (above 1,000° C.) metals is entirely different from the problems of closely coupled atomization of low melting metals such as lead, zinc, or aluminum. The difference is mainly in the degree of reactivity of high reacting alloys with the materials of the atomization apparatus.

One of the features of the closely coupled atomization technology, particularly as applied to high melting alloys such as iron, cobalt, and nickel base superalloys is that such alloys benefit from having a number of the additive elements in solid solution in the alloy rather than precipitated out in the alloy and the closely coupled atomization can result in a larger fraction of additive elements remaining in solid solution. For example, if a strengthening component such as titanium, tantalum, aluminum, or niobium imparts desirable sets of properties to an alloy, this result is achieved largely from the portion of the strengthening additive which remains in solution in the alloy in the solid state. In other words, it is desirable to have certain additive elements such as strengthening elements remain in solid solution in the alloy rather than in precipitated form. Closely coupled atomization is more effective than remotely coupled atomization in producing the small powder sizes which will retain the additive elements in solid solution.

Where still higher concentrations of additive elements are employed above the solubility limits of the additives, the closely coupled atomization technology can result in nucleation of precipitates incorporating such additives. However, because of the limited time for growth of such nucleated precipitates, the precipitate remains small in size and finely dispersed. It is well-known in the metallurgical arts that finely dispersed precipitates are advantageous in that they impart advantageous property improvements to their host alloy when compared, for example, to coarse precipitates which are formed during slow cooling of large particles. Thus, the atomization of such a superalloy can cause a higher concentration of additive elements, such as strengthening elements, to remain in solution, or precipitate as very fine precipitate particles, because of the very rapid solidification of the melt in the closely coupled atomization process. This is particularly true for the finer particles of the powder formed from the atomization.

In this regard, it is known that the rate of cooling of a molten particle of relatively small size in a convective environment such as a flowing fluid or body of fluid material is determined by the properties of the droplet and of the cooling fluid. For a given atomization environment, that is one in which the gas, alloy, and operating conditions are fixed, the complex function relating all the properties can be reduced to the simple proportionality involving particle size shown below, $$T_p \alpha \frac{1}{D_p^2}$$

where:

$T_p$=cooling rate, and $D_p$=droplet diameter,

Simply put, the cooling rate for a hot droplet in a fixed atomization environment is inversely proportional to the diameter squared. Accordingly, the most important way to increase the cooling rate of liquid droplets is to decrease the size of the droplets. This is the function of effective gas atomization.

Thus it follows that if the average size of the diameter of a droplet of a composition is reduced in half, then the rate of cooling is increased by a factor of about 4. If the average diameter is reduced in half again, the overall cooling rate is increased 16 fold.

Since high cooling rates are predominantly produced by reducing droplet size, it is critical to effectively atomize the melt.

The Weber number, We, is the term assigned to the relationship governing droplet breakup in a high velocity gas stream. The Weber number may be calculated from the following expression:

$$We = \frac{\rho V^2 D}{\sigma}$$

where $\rho$ and V are the gas density and velocity, and $\sigma$ and D are the droplet surface tension and diameter.

When the We number exceeds ten, the melt is unstable and will breakup into smaller droplets. The dominant term in this expression is gas velocity and thus in any atomization process it is essential to have high gas velocities. As described in the commonly owned U.S. Pat. No. 4,631,013 the benefit of close coupling is that it maximizes the available gas velocity in the region where the melt stream is atomized. In other words, the close coupling is itself beneficial to effective atomization because there is essentially no loss of gas velocity before the gas stream from the nozzle impacts the melt stream and starts to atomize it.

Because of this relationship of the particle size to the cooling rate, the best chance of keeping a higher concentration of additive elements of an alloy, such as the strengthening additives, in solid solution in the alloy is to atomize the alloy to very small particles. Also, the microstructure of such finer particles is different from that of larger particles and often preferable to that of larger particles.

For an atomization processing apparatus, accordingly the higher the percentage of the finer particles which are produced the better the properties of the articles formed from such powder by conventional powder metallurgical techniques. For these reasons, there is strong economic incentive to produce finer particles through atomization processing.

As pointed out in the commonly owned prior art patents above, the closely coupled atomization technique results in the production of powders from metals having high melting points with higher concentration of fine powder. For example, it was pointed out therein that by the remotely coupled technology only 3% of powder produced industrially is smaller than 10 microns and the cost of such powder is accordingly very high. Fine powders of less than 37 microns in diameter of certain metals are used in low pressure plasma spray applications. In preparing such powders by remotely coupled techniques, as much as 60–75% of the powder must be scrapped because it is oversized. This need to selectively separate out only the finer powder and to scrap the oversized powder increases the cost of useable powder.

Further, the production of fine powder is influenced by the surface tension of the melt from which the fine powder is produced. For melts of high surface tension, production of fine powder is more difficult and consumes more gas and energy. The remotely coupled industrial processes for atomizing such powder have yields of less than 37 microns average diameter from molten metals having high surface tensions of the order of 25 weight % to 40 weight %. A major cost component of fine powders prepared by atomization and useful in industrial applications is the cost of the gas used in the atomization. Using remotely coupled technology, the cost of the gas increases as the percentage of fine powder sought from an atomized processing is increased. Also, as finer and finer powders are sought, the quantity of gas per unit of mass of powder produced by conventional remotely coupled processing increases. The gas consumed in producing powder, particularly the inert gas such as argon, is expensive.

As is explained more fully in the commonly owned patents referred to above, the use of the closely coupled atomization technology of those patents results in the formation of higher concentrations of finer particles than are available through the use of remotely coupled atomization techniques. The texts of the commonly owned patents are incorporated herein by reference.

As is pointed out more fully in the commonly owned U.S. Pat. No. 4,631,013, a number of different methods have been employed in attempts to produce fine powder. These methods have included rotating electrode process, vacuum atomization, rapid solidification rate process and other methods. The various methods of atomizing liquid melts and the effectiveness of the methods is discussed in a review article by A. Lawly, entitled "Atomization of Specialty Alloy Powders", which article appeared in the Jan. 19, 1981 issue of the Journal of Metals. It was made evident from this article and has been evident from other sources that gas atomization of molten metals produces the finest powder on an industrial scale and at the lowest cost.

It is further pointed out in the commonly owned U.S. Pat. No. 4,631,013 that the close coupled processing as described in the commonly owned patents produces finer powder by gas atomization than prior art remotely coupled processing.

A critical factor in the close coupled gas atomization processing of molten metals is the melting temperature of the molten metal to be processed. Metals which can be melted at temperatures of less than 1000° C. are easier to atomize than metals which melt at 1500° to 2000° C. or higher, largely because of the degree of reactivity of the metal with the atomizing apparatus at the higher temperatures. The nature of the problems associated with close coupled atomization is described in a book entitled "The Production of Metal Powders by Atomization", authored by John Keith Beddow, and printed by Haden Publishers, as is discussed more fully in the the commonly owned U.S. Pat. No. 4,631,013.

The problems of attack of liquid metals on the atomizing apparatus is particularly acute when the more reactive liquid metals or more reactive constituent of higher melting alloys are involved. The more reactive metals include titanium, niobium, aluminum, tantalum, and others. Where such ingredients are present in high melting alloys such as the superalloys, the tendency of these metals to attack the atomizing apparatus itself is substantial. For this reason, it is desirable to atomize a melt at as low a temperature as is feasible.

What has been discovered regarding the conventional close coupled atomization is that there is a tendency for the atomization apparatus to freeze up and this freeze-up problem becomes more acute as the degree of superheat in the molten metal to be atomized is reduced.

BRIEF DESCRIPTION OF THE INVENTION

In one of its broader aspects, objects of the present invention can be achieved by providing a close coupled gas atomization apparatus for atomization of molten metals having melting temperatures above 1000° C. The apparatus includes means for supplying melt to be atomized at a relatively low superheat of less than 50° C. The apparatus also includes a melt guide tube means for guiding the melt as a stream and for introducing the stream into an atomization zone. The lower end of the melt guide tube means is inwardly tapered to a melt orifice which is positioned immediately above the atomization zone. The apparatus also includes gas supply means for directing atomizing gas into the atomization zone to atomize the melt as it flows into the zone from the melt guide tube. The gas supply means includes a manifold adapted to receive gas from a gas supply line and to distribute the gas to at least one orifice disposed adjacent the lower end of the melt guide tube. The gas supply means also includes a gas shield forming the inner wall of the manifold and which defines the inner surface of a gas orifice of the at least one gas orifice. The outer surface of the melt guide tube has a highly reflective (low emissivity) coating thereon to limit the emission of radiant heat from the melt guide tube and therefore containing the heat within the melt passing through the melt guide tube.

BRIEF DESCRIPTION OF THE DRAWINGS

The detailed description which follows will be understood with greater clarity if reference is made to the accompanying drawings in which.

DETAILED DESCRIPTION OF THE INVENTION

Figure 1:
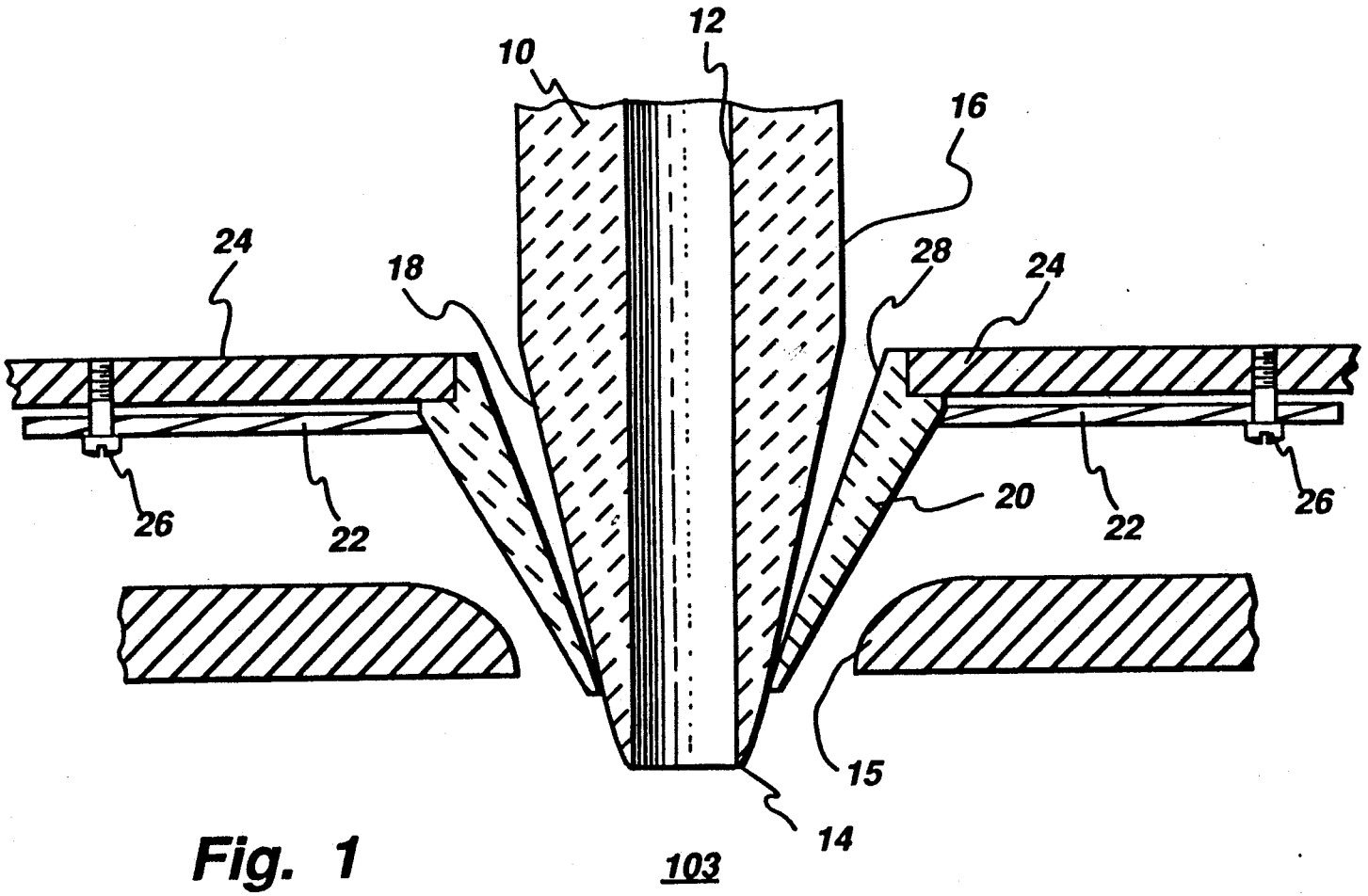
FIG. 1 is a vertical section through a close coupled atomization apparatus.

As has been evident from a number of journal articles and other sources, the powder metallurgy industry has been actively driving toward greatly increased usage of fine powders over the past two decades. One of the reasons is the recognition that superior metallurgical properties are achieved because of the higher solubility of strengthening and similar additives in alloys which are converted into the very fine powder as discussed above. Generally, greater strength, toughness, and fatigue resistance can be attained in articles prepared via the fine powder route for such alloys as compared to the properties found in the same alloys prepared by ingot or other conventional alloy technology. These improvements in properties come about principally due to the extensions of elemental solubility in the solid state which are obtainable via fine powder processing. In other words, the additives preferably remain in solid solution or in tiny nucleated precipitate particles in the host alloy metal and impart the improved properties while in this state as also discussed above. Generally, the finer the powder, the more rapidly it is solidified and the more the solubility limits are extended. In addition, the limits on the alloying additions processed through the fine powder route are increased.

A nemesis of the improved property achieved through fine powder processing however is contamination by foreign materials which enter the powder prior to consolidation. The contamination acts to reduce the local strength, fatigue resistance, toughness, and other properties and thus the contamination becomes a preferred crack nucleation site. Once nucleated, the crack can continue to grow through what is otherwise sound alloy and ultimately results in failure of the entire part.

What is sought pursuant to the present invention is to provide a process capable of manufacture of powder that is both finer and cleaner, and to do so on an industrial scale and in an economical manner.

In order to accomplish this result, one of the problems which must be overcome is to reduce the major source of defects introduced by the prior art conventional powder production process itself. In the conventional powder production process, the alloy to be atomized is first melted in ceramic crucibles and then is poured into a ceramic tundish often by means of a ceramic launder and is finally passed through a gas atomization nozzle employing ceramic components. In the case in which the alloy to be atomized is a superalloy, it is well-known to contain highly reactive components such as titanium, zirconium, molybdenum, and aluminum, among others, and that these metals are highly reactive and have a strong tendency to attack the surfaces of ceramic apparatus which they contact. A typical liquidus temperature of a nickel base superalloy is about 1350° C., for example. The attack can result in formation of ceramic particles and these particles are incorporated into the melt passing through the atomization process and ultimately in the final powder produced by the atomization process. These ceramic particles are a major source of the foreign matter contamination discussed above.

One way in which the conventional extensive use of ceramic containment and ceramic surfaces can be eliminated is through the use of the so-called cold hearth melting and processing apparatus. In this known cold hearth apparatus, a copper hearth is cooled by cold water flowing through cooling channels embedded in the copper hearth. Because the hearth itself is cold, a skull of the metal being processed in the hearth is formed on the inner surface of the hearth. The liquid metal in the hearth thus contacts only a skull of the same solidified metal and contamination of the molten metal by attack of ceramic surfaces is avoided. However, it has now been found that the use of cold hearth processing results in a supply of molten metal which has a very low superheat in comparison to the superheat of metal processed through the prior art ceramic containment devices. The superheat is defined here as a measure of the difference between the actual temperature of the molten alloy melt being processed and the melting point or more specifically the liquidus temperature of that alloy. For apparatus employed in close coupled atomization as described in the commonly owned patents referred to above, higher superheats in the range of 200°-250° C. are employed to prevent the melt from freezing off in the atomization nozzle. For apparatus which is more loosely coupled than that described in these patents, a 100°-250° C. or higher superheat is employed to prevent a melt from excessive loss of heat and freezing during processing.

An important point regarding the processing of melts with low superheats of 50° C. or less is that strengthening and other additives are as fully dissolved in a melt having a low superheat as they are in a melt having a high superheat. Accordingly, improvements in properties of fine powders, of less than 37 micron diameter for example, is found in essentially equal measure in fine powders prepared from melts with low superheats as in fine powders prepared from melts having high superheats.

In using a cold hearth containment to provide a reservoir of molten metal for atomization, it has been found that application of heat to the upper surface of the melt is economic and convenient. Such heat may be applied, for example, by plasma arc mechanisms, by electron beam or by other means. Because a melt contained in a cold hearth loses heat rapidly to the cold hearth itself, it has not been possible to generate significant superheat in the melt. Measured superheats of melts contained in cold hearth indicates that time averaged superheats of up to about 50° C. in magnitude are feasible. Because the melts supplied from cold hearth sources have relatively low superheat of the order of 10°-50° C., there is a much higher tendency for such melts to freeze up in the nozzle of an atomization apparatus. For this reason, attempts to atomize melts having low superheats of less than 50° C. at standard flow rates through the closely-coupled atomization apparatus of the commonly owned patents have failed due to freeze-up of the melt in the atomization nozzle. Herein lies a critical distinction between the processing of melt prepared for atomization in the older ceramic systems as compared to the new cold hearth approach described herein. In practical terms, in the old ceramic system any desired amount of superheat could be attained. Thus, heat extraction by the gas plenum was never addressed in the plenum design. It was possible to simply increase the superheat of the melt to compensate for any heat extraction by the gas plenum. However, in the new cold hearth systems, we have found it impossible to date to produce a superheat of more than 50°-70° C., and we have found this superheat to be insufficient to prevent freeze-off in close coupled atomization using the prior art nozzles of the commonly owned patents referred to above. We have now devised a new gas plenum design that permits atomization with only 50°-70° C. or less superheat. Close coupled atomization of a melt with such low superheat was previously deemed impossible. One important aspect of this invention was to reduce heat flow from the melt to the cold gas plenum. In part, this was accomplished by reducing the vertical dimension of the plenum in the region where the melt must pass thru the plenum.

The U.S. Pat. Nos. 4,578,022; 4,631,013; and 4,778,516; provide discussions of concern with this problem. The text of these patents address and solve many of the issues in the atomization of high temperature melts and the production of fine powder. Noticeably missing, however, is discussion of the issue of freeze-off of the melt stream due to the lack of superheat and the discussion of system limitations that prevent increasing the melt superheat. This is because prior work was done with ceramic melting systems, where for conventional alloys there are no practical limits to how much superheat can be provided. Only with the recent advent of cold hearth melting has it become necessary to solve the problem of increased freeze off due to low superheat. Thus, while the devices disclosed in these and other prior art patents have geometries that are superficially similar to those disclosed herein, they do not make atomization of melts with low superheats of the order of 10°-50° C. feasible.

Figure 3:
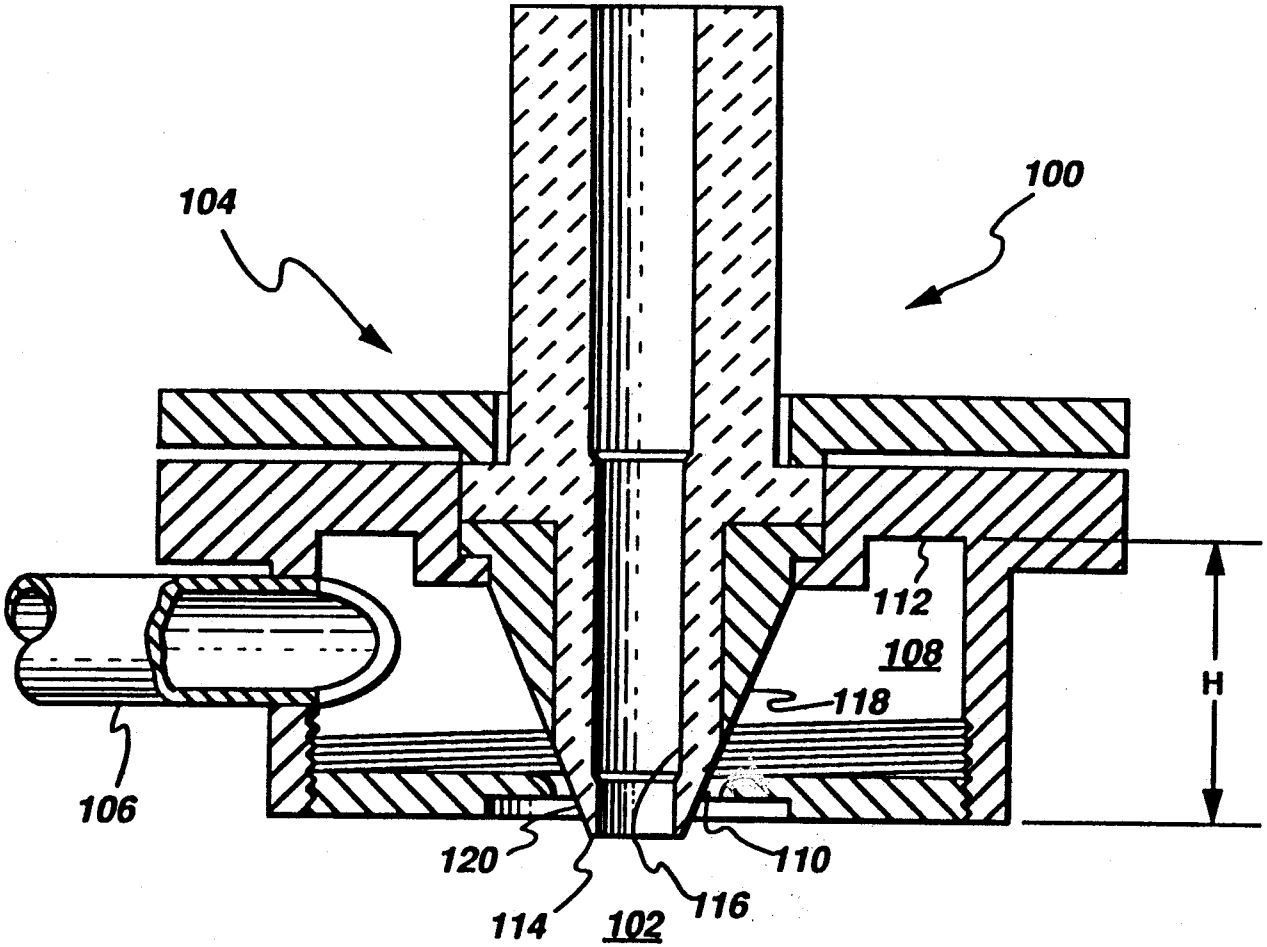
FIG. 3 is a vertical section through a prior art close coupled atomization nozzle.

FIG. 3 is a vertical section of a prior art close coupled atomization as disclosed in commonly owned U.S. Pat. No. 4,631,013 and others referred to above. The mechanism is made up essentially of two parts, the first of which 100 is a melt guide tube for guiding a melt to an atomization zone 102 directly below the lower-most portion of melt guide tube 100. The second portion is gas supply and nozzle arrangement 104 which supplies atomizing gas to the atomization zone 102 through a gas inlet 106, a gas plenum 108, and an annular gas orifice 110. Of particular interest in this mechanism is the vertical distance, H, in which there is a parallel flow of the metal to be atomized and of the atomizing gas. This height, H, shown by the arrow on the right-hand side of the figure illustrates the vertical component of the gas flow from the top 112 of plenum 108 to the bottom 114 of the melt guide tube 100 against which the gas flows both within the plenum 108 and as it exists the plenum through orifice 110.

The height, H, also illustrates the height of the column of liquid metal within the bore 116 of melt guide tube 100 which is in parallel flow with the vertical component of gas flow through the plenum 108 and orifice 110. The gas from pipe 106 expands into plenum 108 and expands further as it leaves orifice 110. In both expansions the gas is spontaneously cooled and spontaneously removes heat from the gas shield 118 and from the inwardly tapered surface 120 of the lower end of melt guide tube 100.

One aspect of improving the start-up of close coupled atomization is a reduction in the height, H, over which there is a parallel flow of atomizing gas and melt to be atomized.

The invention and the features thereof are now described with reference to FIGS. 1 and 2.

Figure 2:
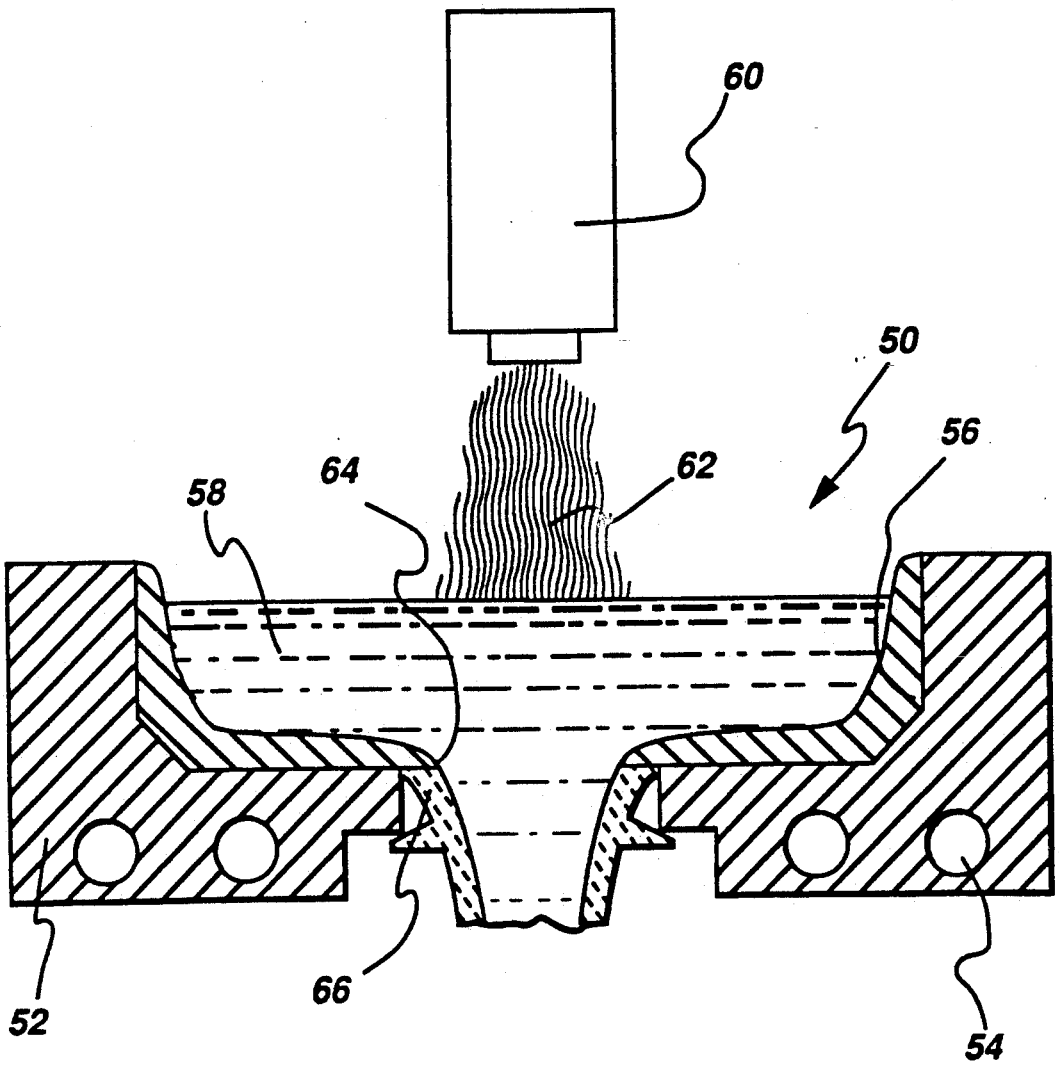
FIG. 2 is a semischematic fragmentary vertical section of the upper portion of a melt guide tube and a cold hearth reservoir supplying melt to the melt guide tube.

In this regard, reference is made next to FIG. 2. In FIG. 2 a melt supply reservoir and the upper portion of a melt guide tube are shown semischematically. The figure is semischematic in part in that the hearth 50 and tube 66 are not in size proportion in order to gain clarity of illustration. The melt supply is from a cold hearth apparatus 50 which is illustrated undersize relative to tube 66. This apparatus includes a copper hearth or container 52 having water cooling passages 54 formed therein. The water cooling of the copper container 52 causes the formation of a skull 56 of frozen metal on the surface of the container 52 thus protecting the copper container 52 from the action of the liquid metal 58 in contact with the skull 56. A heat source 60, which may be for example a plasma gun heat source having a plasma flame 62 directed against the upper surface of the liquid metal of molten bath 58, is disposed above the surface of the reservoir 50. The liquid metal 58 emerges from the cold hearth apparatus through a bottom opening 64 formed in the bottom portion of the copper container 52 of the cold hearth apparatus 50. Immediately beneath the opening 64 from the cold hearth, the top of a melt guide tube 66 is disposed to receive melt descending from the reservoir of metal 58. The top portion of tube 66 is illustrated oversize relative to hearth 50 for clarity of illustration.

The melt guide tube 66 is positioned immediately beneath the copper container 52 and is maintained in contact therewith by mechanical means not shown to prevent spillage of molten metal emerging from the reservoir of molten metal 58 within the cold hearth apparatus 50. The melt guide tube 66 is a ceramic structure which is resistant to attack by the molten metal 58. Tube 66 may be formed of boron nitride, aluminum oxide, zirconium oxide, or other suitable ceramic material. The molten metal flows down through the melt guide tube to the lower portion thereof from which it can emerge as a stream into an atomization zone.

Referring now next to FIG. 1, the figure is a vertical section of the lower end of a close coupled gas atomization apparatus enlarged to show details thereof.

A melt delivery tube 10 is the lower end of tube 66 of FIG. 2 and is provided to carry out the conventional purpose of delivering molten metal from a reservoir of molten metal 58 as illustrated in FIG. 2 to an atomization zone 103 in which atomization of the metal is carried out. The melt from reservoir 58 flows in contact with the inner surface 12 of the melt guide tube and emerges from the tube 10 at its lowermost point 14 into zone 103 where the stream of emerging metal is contacted by a stream of atomizing gas in the closely coupled manner as discussed above.

The outer surface 16 of the upper portion of the melt guide tube 10 may be generally parallel to the inner surface 12 to provide a generally cylindrical tubular form to the upper part of melt guide tube 10. Alternatively, the tube may be flared outwardly as illustrated in FIG. 2. The lower end 18 of the melt guide tube is tapered inwardly to provide an inward and downward component to the shape of the lower end 18 of the tube and to provide access of the atomizing gas to the emerging melt stream. A gas shield 20 is part of a gas delivery system which provides the atomizing gas as a stream down into atomization zone 103 to atomize the melt descending through melt guide tube 10 and exiting tube at the lowermost point 14 thereof. The gas is directed against the melt stream emerging from tube 10 at least in part as a result of contact with the gas shield 20. This gas is deflected by shield 20 down and into contact with the emerging stream of molten metal exiting the melt guide tube 10 through the orifice 15 provided adjacent the lowest point 14 of the melt guide tube 10. The horizontal members 22 and 24 constitute part of the manifold or plenum through which the gas passes before emerging as a stream to contact the stream of molten metal descending through melt guide I0. Screw member 26 effectively bonds the two members 22 and 24 together as part of the manifold.

Pursuant to the present invention, the surface 18 of the melt guide tube 10 and the surface 28 of the gas shield 20 are coated with heat reflecting (low emissivity) surface layers. Such surface layers may be a mirror-like layer Of metal such as palladium or platinum or one of the other noble metals. Generally, metals which are not subject to oxidation or other reactive modification are preferred. Additionally, the coating material used on the metal guide tube must have a melting point above the temperature of the alloy being atomized. Coatings of a mirror-like character of palladium or platinum are suitable for this purpose.

The high reflectivity (low emissivity) coating on the surface 18 of the melt guide tube 10 limits the emission of radiant heat from the melt guide tube. Furthermore, the high reflectivity coating on the surface 28 of the gas shield 20 reflects any radiant heat coming from melt guide tube back into the tube.

From studies which I have made for a structure such as that illustrated in FIG. 1, if the surfaces 18 and 28 are coated with a highly reflective mirror-like coating, the radiation heat loss through these surfaces is reduced by a factor of 8. This is based on a radiant heat loss of 55 watts in the absence of the highly reflective coatings and my finding that the radiant heat loss will be reduced to less than 7 watts.

Such a reduction in radiant heat loss through radiant energy is very significant when compared to the superheat of less than 50° C. of the melt being processed through the atomization apparatus of FIG. 1.

The principal criteria for high reflectivity of the surfaces of the atomization structure which can reflect radiant heat back toward the point at which radiation is emitted is a highly reflective metal surface. Highly reflective metal surfaces can be achieved by placing a highly polished foil such as a metal foil on the outside of the melt guide tube and also on the outside of the gas shield. For example, we have successfully used this technique by placing a highly polished foil of molybdenum metal at the appropriate locations to reflect the radiant heat back toward its source. The molybdenum foil was cut from a sheet and was wrapped around the appropriate surface of the melt guide tube. Other metal foils having a high polish can be employed as well. Such foils or other deposits of metal which are applied to the melt guide tube should have a high melting point above the melting point of the melt to be atomized. However, the deposit of a reflecting metal surface on the external surface of the gas shield may not be of a metal which has such a high melting point inasmuch as the temperature of the gas shield does not rise to above the melting point of the melt in the melt guide tube. Thus, while a foil of molybdenum can be usefully employed on the external surface of the melt guide tube, a foil of aluminum can be employed on the external surface of the gas shield where the temperature of the gas shield does not rise above the melting point of the aluminum foil. Other foils of other metals may be usefully employed where foils have at least one highly reflecting surface. Gold foils, palladium foils, platinum foils, and foils of other metals having relatively high melting points are very convenient for use in this regard.

Alternatively, the external surface of the melt guide tube and the external surface of the gas shield can be coated directly with highly reflecting layers of metal such as palladium, platinum, and other metals having lustrous surfaces. Such surface coating may be by electrocoating or electroless plating or by sputtering or other means by which a highly reflective surface deposit may be applied.

What is claimed is:

1. An atomization apparatus for atomizing metal with low superheat which comprises, a ceramic melt guide tube extending between a supply of liquid metal with a low superheat and an atomization zone below a lower orifice of said tube, said tube having an inwardly tapered lower end, a gas supply means disposed annularly around the lower end of said melt guide tube and adapted to supply an atomizing jet of gas against the lowermost portion of said tube and against metal melt emerging from said tube, said gas supply means having an annular gas plenum surrounding the lower portion of said tube, said plenum including a gas shield disposed to deflect gas leaving said plenum through a gas orifice at the lower end of said shield, the lower inwardly tapered outer surface of the melt guide tube and the inner surface of the as shield being spaced from and confronting each other, and said surfaces having a heat reflective metal surface layer selected from the group consisting of platinum, gold, and molybdenum formed thereon.

2. The apparatus of claim 1, in which at least one surface layer is an alloy of platinum.

3. The apparatus of claim 1, in which at least one surface layer is an alloy of gold.

4. The apparatus of claim 1, in which at least one surface layer is a foil of molybdenum.

* * * * *